US005901957A

United States Patent [19]

Leyva et al.

[11] Patent Number: 5,901,957

[45] Date of Patent: May 11, 1999

[54] CHESS GAME WITH ARCHER PIECES

[76] Inventors: Peter E. Leyva; Erik J. Konn, both of 1824 S. Fourth St., Alhambra, Calif. 91803

[21] Appl. No.: 08/943,434

[22] Filed: Oct. 3, 1997

[51] Int. Cl.[6] ..... A63F 3/02

[52] U.S. Cl. ..... 273/261

[58] Field of Search ..... 273/260, 261

[56] References Cited

U.S. PATENT DOCUMENTS

| | | | |
|---|---|---|---|
| 511,306 | 12/1893 | Moore | 273/261 |
| 1,134,922 | 4/1915 | Smith | 273/261 |
| 4,147,360 | 4/1979 | Bailey | 273/261 |
| 5,280,913 | 1/1994 | Sirk | 273/261 |
| 5,749,583 | 5/1998 | Sadounichvili | 273/261 |

*Primary Examiner*—William E. Stoll

*Attorney, Agent, or Firm*—Sheldon & Mak; Denton L. Anderson

[57] ABSTRACT

A chess game variation is provided generally played by the traditional rules of chess, except that each player initially has eight "archer" pieces initially disposed on each player's third and fourth ranks on squares having the same color. Each archer piece moves in a manner similar to that of a pawn, but with several notable exceptions, including the ability to always move one square or two squares forward, and the ability to capture along the same file. The game markedly changes the traditional strategies formulated for the game of chess, and therefore provides a game having new mystery and excitement.

7 Claims, 3 Drawing Sheets

CHESS GAME WITH ARCHER PIECES

FIELD OF THE INVENTION

This invention relates generally to games and, more specifically, to variants of the game of chess.

BACKGROUND

Chess is an extremely popular game throughout the world. However, especially with the advent of super computers, the game of chess has been analyzed in such detail that much of its mystery, and therefore, much of its charm, has disappeared.

Accordingly, there is a need for a new chess game variant having new pieces which move in new ways. Such a new variant would reinstill the mystery and charm to the game of chess.

SUMMARY

The invention satisfies this need. The invention is a chess game variant played by the traditional rules of chess, except that both sides possess eight additional archer pieces initially disposed on each player's third and fourth ranks on squares having the color of the square on which the player's king is initially placed, i.e., black squares for White and white squares for Black. Each archer moves much in the way that a traditional pawn moves, but with some exceptions. On a player's turn, a player may move any of its archers in one of the following ways: (a) to a new square one square forward, if such new square is not occupied except by an opponent's queen, rook, bishop, knight, archer or pawn; (b) to a new square two squares forward, if such new square is not occupied except by an opponent's queen, rook, bishop, knight, archer or pawn, and if the intervening square one square forward is unoccupied; (c) to a new square diagonally forward and to the left one square if such new square is occupied by an opponent's queen, rook, bishop, knight, archer or pawn, or if such new square is immediately behind an opponent's archer which, on the immediately preceding move by the opponent, moved forward two squares, or if such new square is immediately behind an opponent's pawn which, on the immediately preceding move by the opponent, moved from the opponent's second rank to the opponent's fourth rank; and (d) to a new square diagonally forward and to the right one square if such new square is occupied by an opponent's queen, rook, bishop, knight, archer or pawn, or if such new square is immediately behind an opponent's archer which, on the immediately preceding move by the opponent, move forward two squares, or if such new square is immediately behind an opponent's pawn which, on the immediately preceding move by the opponent, move from the opponent's second rank to the opponent's fourth rank.

Additionally, (1) if an archer is moved to a new square occupied by an opponent's piece, that opponent's piece is removed from the board; (2) an archer is removed from the board if an opponent's piece is moved to the square on which the archer is then disposed; (3) an archer can also be captured en passant immediately after it has moved two squares forward, by moving an opponent's pawn or archer disposed immediately to the side of that archer to the square immediately behind that archer; (4) a side whose turn it is to move is in check if the opposing side then threatens on the opposing side's next move to occupy the square on which the king of the side whose turn it is to move is presently disposed with an archer of the opponent; (5) neither side can castle by moving its king through a square which, if the king were to occupy that square, would place the king in check; and (6) an archer which reaches the back rank of an opponent is promoted to a queen, rook, bishop or knight.

In one embodiment, the game is played on a traditional chess board having 8 files, but having 12 ranks. The game can also be played as a four-player game using a board having a cross shape.

The invention provides an intriguing new variation to the game of chess which radically changes all of the previously analyzed strategies. The invention thus provides a chess game with renewed mystery and appeal.

DRAWINGS

These features, aspects and advantages of the present invention will become better understood with regard to the following description, appended claims and accompanying figures where:

DETAILED DESCRIPTION OF CERTAIN EMBODIMENTS

Figure 1:
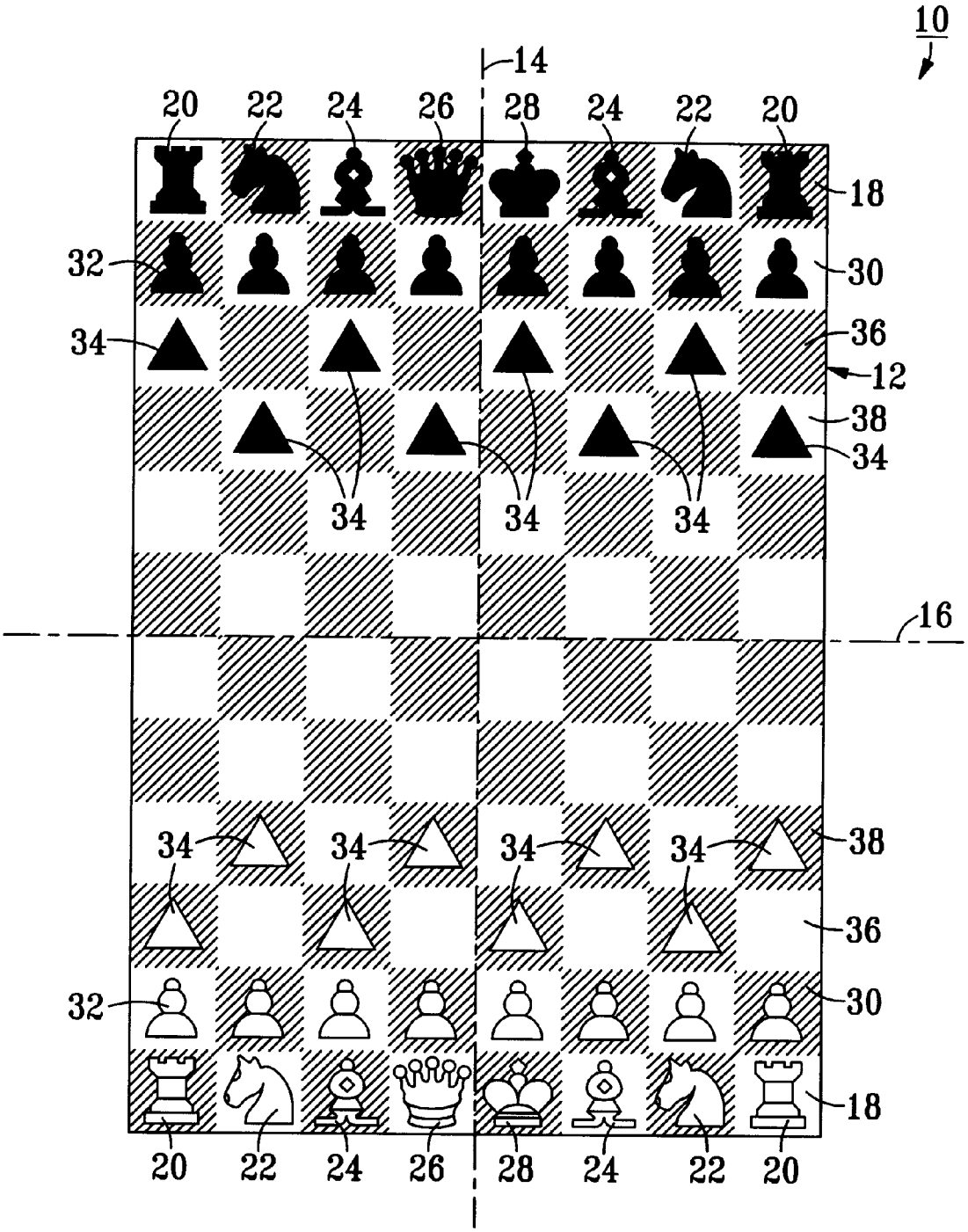
FIG. 1 is a diagrammatic view of a game having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a game 10 played on a flat board 12 having a checkerboard pattern comprising files and ranks. As used herein, the terms "files" and "ranks" are used in the same sense as they are used in the game of chess to describe longitudinal rows of squares (files) and horizontal rows of squares (ranks).

In the embodiments illustrated in the drawings, the board is symmetrical with respect to a longitudinal axis 14 and to a horizontal axis 16. Typically, players sit on opposite sides of the board and face each other.

The game comprises traditional chess pieces initially set up on the board 12 pursuant to the rules of chess. That is, the player having the white pieces has pieces disposed on the player's back rank 18 (the rank furthest away from the Black player's pieces) which include from left to right a rook 20, knight 22, bishop 24, queen 26, king 28, bishop 24, knight 22 and rook 20. The king 28 is disposed on a black square. The player having the black pieces has on that player's back rank 18 pieces consisting of, from left to right, a rook 20, knight 22, bishop 24, king 28, queen 26, bishop 24, knight 22 and rook 20. The king 28 of the player having the black pieces is initially disposed on a white square. On each player's second rank 30 (the rank immediately forward of each player's back rank), each player has a row of eight pawns 32. Each of the aforementioned traditional chess pieces moves, except for the exceptions noted below, pursuant to the traditional rules of chess.

In the invention, each player initially possesses eight new pieces, termed "archer pieces" 34 herein. In the embodiments illustrated in the drawings, the eight archer pieces 34 are initially disposed on each player's third and fourth ranks 36 and 38, respectively, on squares having the same color as the square on which that player's king 28 is initially placed.

In a typical embodiment of the invention, the pieces are disposed on an 8×12 board 12 having 8 files and 12 ranks. The player having the white pieces typically moves first, although this is not critical in the invention.

Each archer piece 34 can be alternatively moved on a side's turn as follows: (a) to a new square one square forward, if such new square is not occupied except by an opponent's queen 26, rook 20, bishop 24, knight 22, archer 34 or pawn 32; (b) to a new square two squares forward, if such new square is not occupied except by an opponent's queen 26, rook 20, bishop 24, knight 22, archer 34 or pawn 32, and if the intervening square one square forward is unoccupied; (c) to a new square diagonally forward and to the left one square if such new square is occupied by an opponent's queen 26, rook 20, bishop 24, knight 22, archer 34 or pawn 32, or if such new square is immediately behind an opponent's archer which, on the immediately preceding move by the opponent, moved forward two squares, or if such new square is immediately behind an opponent's pawn 32 which, on the immediately preceding move by the opponent, moved from the opponent's second rank to the opponent's fourth rank; and (d) to a new square diagonally forward and to the right one square if such new square is occupied by an opponent's queen 26, rook 20, bishop 24, knight 22, archer 34 or pawn 32, or if such new square is immediately behind an opponent's archer which, on the immediately preceding move by the opponent, move forward two squares, or if such new square is immediately behind an opponent's pawn 32 which, on the immediately preceding move by the opponent, move from the opponent's second rank to the opponent's fourth rank.

If an archer 34 is moved to a new square occupied by an opponent's piece, that opponent's piece is removed from the board 12.

An archer 34 is removed from the board 12 if an opponent's piece is moved to the square on which the archer 34 is then disposed.

An archer 34 can also be captured en passant immediately after it has moved two squares forward, by moving an opponent's pawn 32 or archer 34 disposed immediately to the side of that archer 34 to the square immediately behind that archer 34. The term "en passant" as used herein is used in the same sense as it is under the traditional rules of chess.

A side whose turn it is to move is in check if the opposing side then threatens on the opposing side's next move to occupy the square on which the king 28 of the side whose turn it is to move is presently disposed with an archer 34 of the opponent.

Neither side can castle by moving its king 28 through a square which, if the king 28 were to occupy that square, would place the king 28 in check.

An archer 34 which reaches the back rank 18 of an opponent is promoted to a queen 26, rook 20, bishop 24 or knight 22.

Although the invention is ideally suited to an 8×12 square board, other boards 12 comprised of a plurality of rectangular board sections, each board section having at least two rows of squares of eight rows each can be used in the invention.

Figure 2:
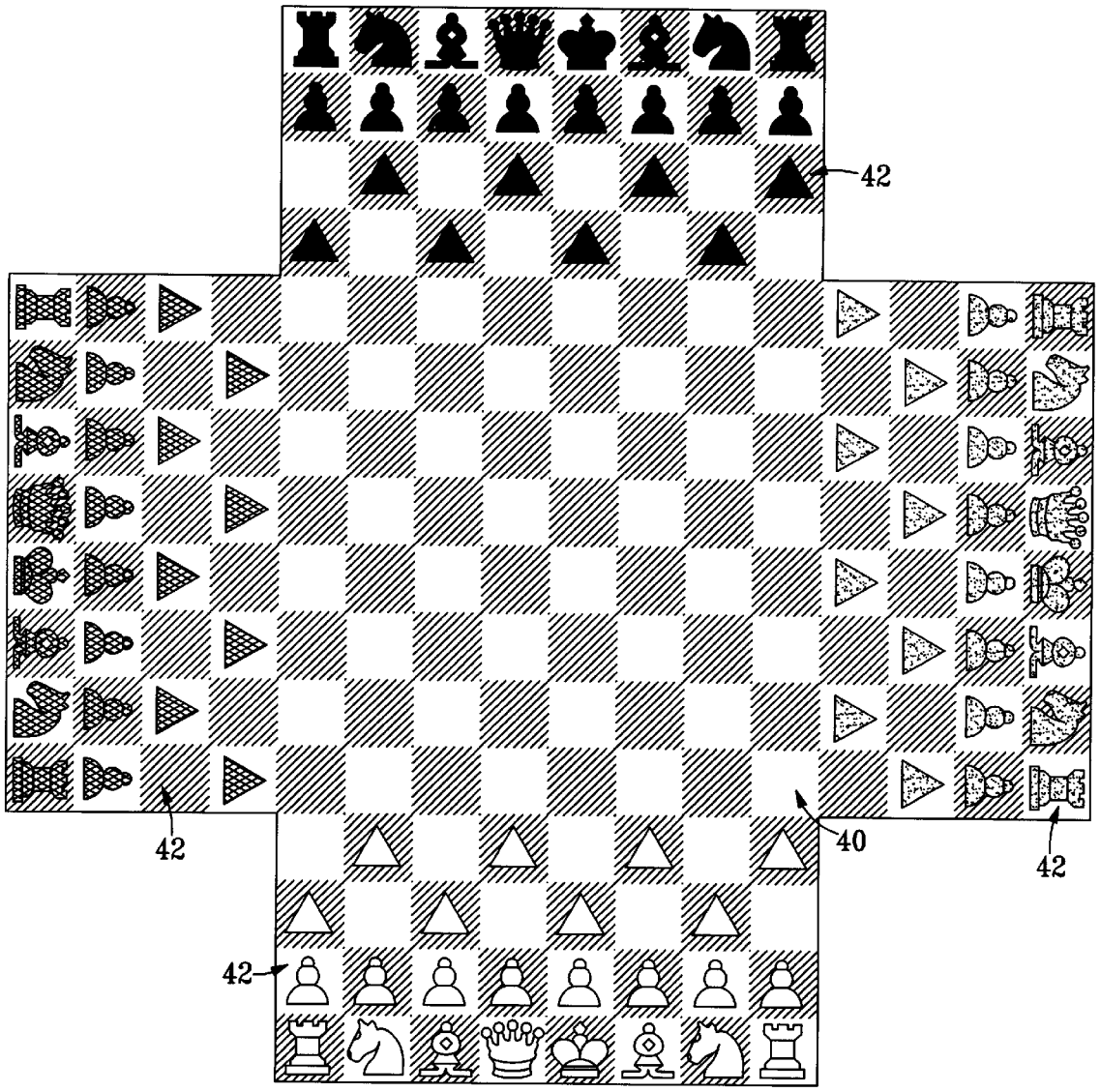
FIG. 2 is a diagrammatic view of a second game having features of the invention.

In one variation of the invention illustrated in FIG. 2, the board 12 comprises a central board section 40 consisting of eight rows of squares, each row having eight squares and two pairs of opposed side board sections 42, each side board section 42 having four rows of squares, each row having eight squares. This particular board 12 can be used as illustrated in FIG. 2 to provide a four-player game between a first player having white pieces, a second player having cross-matched pieces, a third player having back pieces and a fourth player having dotted pieces. This four-player game uses all of the rules described above with the following exceptions: (a) a first player initially has his king 28 on a dark square and his archers 34 on dark squares; (b) a second player sitting to the left of the first player initially has his king 28 on a light square and his archers 34 on light squares; (c) a third player sitting to the left of the second player initially has his king 28 on a light square and his archers 34 on dark squares; (d) a fourth player sitting to the left of the third player initially has his king 28 on a dark square and his archers 34 on light squares; (e) the forward direction of that archer 34 or pawn 32 is re-defined as the direction towards the back rank 18 of the side board section 38 to which the archer 34 or pawn 32 has moved; and (f) such archer 34 or pawn 32 is promoted to a queen 26, rook 20, bishop 24 or knight 22 when it reaches the back rank 18 of the side board section 42 to which it has moved.

Figure 3A:
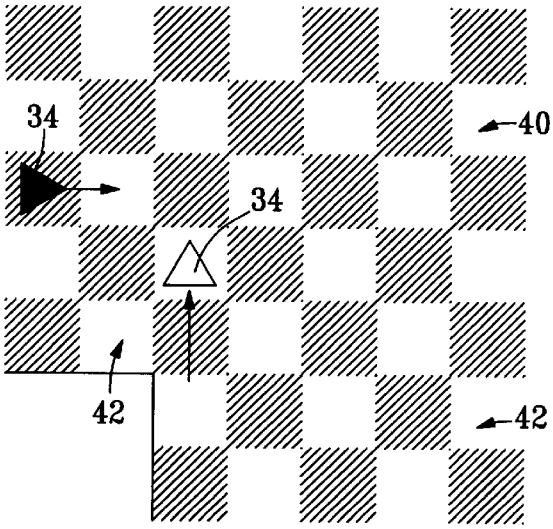
FIGS. 3A–3C are detail views of a playing board section illustrating certain features of the invention.
Figure 3B:
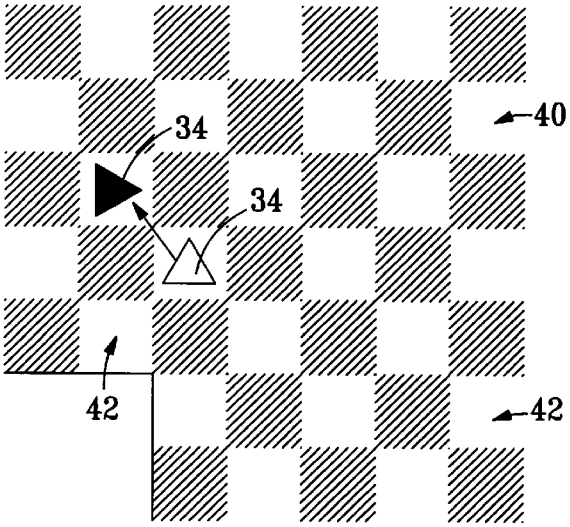
Figure 3C:
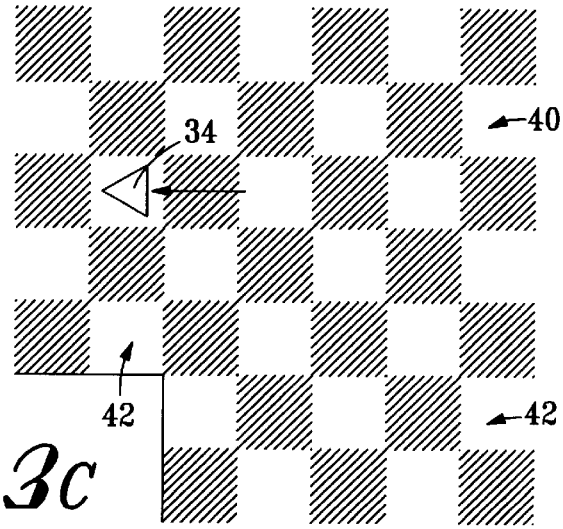

Exception (e) is illustrated in FIGS. 3A, 3B and 3C. FIG. 3A illustrated a typical portion of a board 12 such as illustrated in FIG. 2. A portion of a central board section 40 is illustrated at the center of FIG. 3A. Portions of side board sections 42 are illustrated to the left and below the central board section 40. A white archer 34 is illustrated on a white square at the edge of the central board section 40. That white archer 34 is proceeding in a direction which is upward on FIG. 3A. Also illustrated is a black archer piece 34 disposed on a black square on the portion of the side board section 42 to the left of the central board section 40. That black archer 34 is moving from left to right on FIG. 3A. FIG. 3B illustrates a configuration of the two archer pieces 34 after the black archer 34 has moved one square forward (to the right on FIG. 3B). FIG. 3B also indicates that the relative position of the pieces allows the white archer 34 to capture the black archer 34 by moving diagonally as illustrated in FIG. 3B. FIG. 3C illustrates the configuration of the white archer 34 after it has captured the black archer 34. Now that the white archer 34 has moved from the central board section 40 to the side board section 42, the nominal direction of the white archer 34 has shifted 90° so that it now is proceeding in a generally right to left direction.

In the variation illustrated in FIG. 2, the number of players can be two, three or four.

The invention provides an innovative new variation to the game of chess which radically changes all of the previously analyzed strategies. The invention thus provides a chess game with renewed mystery and appeal.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A game played between at least a first side and an opposing side, the game being governed by the rules of chess, except:

(a) the game board comprises at least 12 rows of squares from the back rank of one side to the back rank of the directly opposite side;

(b) prior to the first move being made, each side has 8 archer pieces disposed on its third and fourth ranks, each archer being initially disposed on squares having the same color;

(c) each archer can be alternatively moved on a side's turn as follows:

(1) to a new square one square forward, if such new square is not occupied except by an opponent's queen, rook, bishop, knight, archer or pawn;

(2) to a new square two squares forward, if such new square is not occupied except by an opponent's queen, rook, bishop, knight, archer or pawn, and if the intervening square one square forward is unoccupied;

(3) to a new square diagonally forward and to the left one square if such new square is occupied by an opponent's queen, rook, bishop, knight, archer or pawn, or if such new square is immediately behind an opponent's archer which, on the immediately preceding move by the opponent, moved forward two squares, or if such new square is immediately behind an opponent's pawn which, on the immediately preceding move by the opponent, moved from the opponent's second rank to the opponent's fourth rank;

(4) to a new square diagonally forward and to the right one square if such new square is occupied by an opponent's queen, rook, bishop, knight, archer or pawn, or if such new square is immediately behind an opponent's archer which, on the immediately preceding move by the opponent, move forward two squares, or if such new square is immediately behind an opponent's pawn which, on the immediately preceding move by the opponent, move from the opponent's second rank to the opponent's fourth rank;

(d) if an archer is moved to a new square occupied by an opponent's piece, that opponent's piece is removed from the board;

(e) an archer is removed from the board if an opponent's piece is moved to the square on which the archer is then disposed;

(f) an archer can also be captured en passant immediately after it has moved two squares forward, by moving an opponent's pawn or archer disposed immediately to the side of that archer to the square immediately behind that archer;

(g) a side whose turn it is to move is in check if the opposing side then threatens on the opposing side's next move to occupy the square on which the king of the side whose turn it is to move is presently disposed with an archer of the opponent;

(h) neither side can castle by moving its king through a square which, if the king were to occupy that square, would place the king in check; and (i) an archer which reaches the back rank of an opponent is promoted to a queen, rook, bishop or knight.

2. The game of claim 1 wherein the game board consists of 12 rows of squares, each row having 8 squares.

3. The game of claim 1 wherein the game board is comprised of a plurality of rectangular board sections, each board section having at least two rows of squares, each row having 8 squares.

4. The game of claim 1 wherein the game board comprises a central board section consisting of 8 rows of squares, each row having 8 squares, and 2 pairs of opposed side board sections, each side board section having 4 rows of squares, each row having 8 squares.

5. The game of claim 4 having the additional exception to the rules of chess that if an archer or a pawn moves from one side board section to another side board section or from the central board section to a side board section:

(a) the forward direction of that archer or pawn is re-defined as the direction towards the back rank of the side board section to which the archer or pawn has moved; and (b) such archer or pawn is promoted to a queen, rook, bishop or knight when it reaches the back rank of the side board section to which it has moved.

6. The game of claim 5 wherein the number of opposing sides is at least 3.

7. The game of claim 5 wherein the number of opposing sides is 4 and wherein:

(a) a first opposing side initially has his king on a dark square and his archers on dark squares;

(b) a second opposing side sitting to the left of the first opposing side initially has his king on a light square and his archers on light squares;

(c) a third opposing side sitting to the left of the second opposing side initially has his king on a light square and his archers on dark squares; and (d) a fourth opposing side sitting to the left of the third player initially has his king on a dark square and his archers on light squares.

* * * * *